US008319694B2

(12) United States Patent
Yang et al.

(10) Patent No.: US 8,319,694 B2
(45) Date of Patent: Nov. 27, 2012

(54) COMPACT DUAL-MODE UHF RFID READER ANTENNA SYSTEMS AND METHODS

(75) Inventors: Guangli Yang, Middle Island, NY (US); Dean V. La Rosa, Bohemia, NY (US); Xiaotao Liang, Dix Hills, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 478 days.

(21) Appl. No.: 12/635,954

(22) Filed: Dec. 11, 2009

(65) Prior Publication Data

US 2011/0140977 A1 Jun. 16, 2011

(51) Int. Cl.
*H01Q 21/00* (2006.01)
*G08B 13/14* (2006.01)

(52) U.S. Cl. ..... 343/725; 343/700 MS; 343/767; 343/876; 340/572.7

(58) Field of Classification Search ..... 343/725, 343/700 MS, 767, 876; 340/572.7
See application file for complete search history.

(56) References Cited

U.S. PATENT DOCUMENTS

| | | | | |
|---|---|---|---|---|
| 4,835,540 | A * | 5/1989 | Haruyama et al. | 343/700 MS |
| 5,914,693 | A * | 6/1999 | Takei et al. | 343/767 |
| 6,326,923 | B2 * | 12/2001 | Shigihara | 343/700 MS |
| 7,196,668 | B2 * | 3/2007 | Lin et al. | 343/702 |
| 7,262,740 | B2 | 8/2007 | Tikhov et al. | |
| D574,370 | S | 8/2008 | Oliver | |
| 7,427,955 | B2 | 9/2008 | Choi et al. | |
| 7,934,660 | B2 * | 5/2011 | Yeakley et al. | 235/472.01 |
| 2006/0208901 | A1 * | 9/2006 | Kai et al. | 340/572.7 |
| 2008/0129511 | A1 * | 6/2008 | Yuen et al. | 340/572.7 |
| 2009/0174557 | A1 | 7/2009 | Nikitin et al. | |

FOREIGN PATENT DOCUMENTS

WO 2005038983 A1 4/2005

OTHER PUBLICATIONS

Yang, Fan et al.: "Wire Antenna on an EBG Ground Plane Vs. Patch Antenna: A Comparative Study on Low Profile Antennas", EMTS 2007 International URSI Commission B—Electromagnetic Theory Symposium, Jul. 26-28, 2007, Ottawa, ON, Canada, all pages.

Ansari, J. A. et al.: "Broadband Stacked U-Slot Microstrip Patch Antenna", Progress in Electromagnetics Research Letters, vol. 4, 17-24, 2008, all pages.

Huang, J. J. et al.: "A Novel Multiband and Broadband Fractal Patch Antenna", Progress in Electromagnetics Research Symposium 2006, Cambridge, USA, Mar. 26-29, pp. 57-59.

* cited by examiner

*Primary Examiner* — Dieu H Duong
(74) *Attorney, Agent, or Firm* — Terri Hughes Smith; Kenneth A. Haas

(57) ABSTRACT

The present disclosure relates to compact, dual-mode ultra high frequency (UHF) radio frequency identification (RFID) reader antenna systems and methods capable of supporting both long range and short range applications. The present invention includes a dual-mode antenna design, a dual-mode RFID reader utilizing the dual-mode antenna design, and an associated usage method. The dual-mode antenna design may include a patch operating mode for long range applications and a slot operating mode for short range applications. Additionally, the dual-mode antenna design may include mechanisms to improve the patch operating mode bandwidth, circular polarization in the patch operating mode, and dual polarization in the slot operation mode.

4 Claims, 12 Drawing Sheets

COMPACT DUAL-MODE UHF RFID READER ANTENNA SYSTEMS AND METHODS

FIELD OF THE INVENTION

The present invention relates generally to wireless antennas. More particularly, the present invention relates to compact, dual-mode Ultra High Frequency (UHF) Radio Frequency Identification (RFID) reader antenna systems and methods capable of supporting both long range and short range applications with a patch mode and slot mode antenna each disposed on opposing sides of a ground plane.

BACKGROUND OF THE INVENTION

Conventionally, UHF RFID readers are generally used for two purposes: one is long range (e.g. greater than 8 ft) for warehousing and the other is short range (e.g. less than 5 ft) for inventory. There are many factors affecting an antenna's read range. For example, in terms of a long range antenna, there is a need for high gain (such as using a yagi or patch antenna configuration) whereas short range antennas needs wide beamwidth antenna (such as a dipole antenna configuration). Conventionally, RFID reader antennas only address either short range or long range applications, but not both unless a RFID reader includes two separate, individual antennas for each of the applications. Thus, there is a need to have a single antenna capable of operating in both long range and short range applications.

BRIEF SUMMARY OF THE INVENTION

In an exemplary embodiment, an antenna for use in RFID includes a ground plane with a first side and a second side, wherein the first side opposes the second side; a patch mode antenna disposed on the first side; a slot mode antenna disposed on the second side; and circuitry configured to switch between the patch mode antenna and the slot mode antenna. Optionally, the antenna may further include a radio frequency module disposed on the ground plane on the second side; a connection from the radio frequency module to the patch mode antenna on the first side through a patch feed in the ground plane; and a connection from the radio frequency module to the slot mode antenna through a slot feed on the slot mode antenna. The patch mode antenna may include a patch disposed on the ground plane between one of foam or a dielectric substrate and a patch feed through the patch on the first side to the second side; wherein the patch and the ground plane are dimensioned based on an operating wavelength of the antenna; and wherein the slot mode antenna includes a slot in the ground plane dimensioned based on the operating wavelength of the antenna and a slot feed disposed on the slot. Optionally, the patch may be dimensioned at approximately one-half of the operating wavelength, and the slot may be dimensioned at approximately one and a half times of the operating wavelength in total length. Alternatively, a top edge of the patch may be grounded, wherein the patch is dimensioned at approximately one-fourth of the operating wavelength, and the slot may be dimensioned at approximately one half times of the operating wavelength in total length.

The patch mode antenna may operate in a first mode and the slot mode antenna may operate in a second mode, and wherein the first mode is engineered with respect to operating parameters to operate in a longer range than the second mode. The slot may include a first linear channel, a second linear channel, and a third linear channel, wherein the first linear channel and the second linear channel are substantially the same length each running vertically on the ground plane and opposing one another, and wherein the third linear channel running horizontally on the ground plane connecting top ends of each of the first linear channel and the second linear channel together. A position of the slot on the second side of the ground plane may be offset vertically from a position of the patch on the first side of the ground plane thereby avoiding radiation pattern impact in a designed read direction. Optionally, the patch may include one or more slots disposed within the patch thereby improving bandwidth of the patch mode antenna. The one or more slots may form one of a U-shaped pattern, an E-shaped pattern, or a fractal pattern. Alternatively, the ground plane may include an electromagnetic bandgap structured material disposed on the first side between the ground plane and the patch, wherein the electromagnetic bandgap structured material is configured to provide a set bandwidth of the patch mode antenna. Additionally, the patch mode antenna may be configured to provide circular polarization through one or more slots disposed in the patch. In one example, the patch mode antenna is configured for a peak gain of approximately 4.7 dBi, the slot mode antenna is configured for a peak gain of approximately 3.6 dBi with a donut shape, and each of the patch mode antenna and the slot mode antenna includes approximately 26 MHz of bandwidth. Optionally, the patch mode antenna may include a patch disposed on the ground plane between one of foam or a dielectric substrate and a patch feed through the patch on the first side to the second side; wherein the patch and the ground plane are dimensioned based on an operating wavelength of the antenna; and wherein the slot mode antenna is configured for dual-polarization and includes a first slot for horizontal polarization, a second slot for vertical polarization, a first slot feed on the first slot, a second slot feed on the second slot, and a power dividing device connected to each of the first slot feed and the second slot feed.

In another exemplary embodiment, a RFID reader includes a housing; one or more input devices; an output display; a dual-mode antenna disposed in the housing, wherein the dual-mode antenna includes a ground plane with a first side including a patch mode antenna and a second side including a slot mode antenna; a radio frequency module disposed on the ground plane on the second side; a connection from the radio frequency module to the patch mode antenna on the first side through a patch feed in the ground plane; a connection from the radio frequency module to the slot mode antenna through a slot feed on the slot mode antenna; and a switching mechanism for operating the dual-mode antenna with either the patch mode antenna for a first operational mode or the slot mode antenna for a second operation mode. The patch mode antenna may include a patch disposed on the ground plane between one of foam or a dielectric substrate and a patch feed through the patch on the first side to the second side; wherein the patch and the ground plane are dimensioned based on an operating wavelength of the antenna; and wherein the slot mode antenna includes a slot in the ground plane dimensioned based on the operating wavelength of the antenna and a slot feed disposed on the slot. A position of the slot on the second side of the ground plane may be offset vertically from a position of the patch on the first side of the ground plane thereby avoiding radiation pattern impact in a designed read direction. Optionally, the patch mode antenna may be configured to operate with circular polarization and the slot mode antenna is configured to operate with dual-polarization.

In yet another exemplary embodiment, a method includes providing a RFID reader including a dual-mode antenna configured to operate in one of a first mode or a second mode, wherein the dual-mode antenna includes: a ground plane including a first side and a second side, wherein the first side opposes the second side; a patch mode antenna disposed on the first side, wherein the patch mode antenna comprises a patch disposed on the ground plane between one of foam or a dielectric substrate and a patch feed through the patch on the first side to the second side, and wherein the patch and the ground plane are dimensioned based on an operating wavelength of the antenna; a slot mode antenna disposed on the second side, wherein the slot mode antenna includes a slot in the ground plane dimensioned based on the operating wavelength of the antenna and a slot feed disposed on the slot; and circuitry configured to switch between the patch mode antenna and the slot mode antenna; setting the RFID reader to the first mode; operating the RFID reader in the first mode; switching the RFID reader to the second mode; and operating the RFID reader in the second mode.

BRIEF DESCRIPTION OF THE DRAWINGS

The present invention is illustrated and described herein with reference to the various drawings of exemplary embodiments, in which like reference numbers denote like method steps and/or system components, respectively, and in which.

DETAILED DESCRIPTION OF THE INVENTION

In various exemplary embodiments, the present invention relates to compact, dual-mode UHF RFID reader antenna systems and methods capable of supporting both long range and short range applications. The present invention includes a dual-mode antenna design, a dual-mode RFID reader utilizing the dual-mode antenna design, and an associated usage method. The dual-mode antenna design may include a patch operating mode for long range applications and a slot operating mode for short range applications. Additionally, the dual-mode antenna design may include mechanisms to improve the patch operating mode bandwidth, circular polarization in the patch operating mode, and dual polarization in the slot operation mode.

Figure 1:
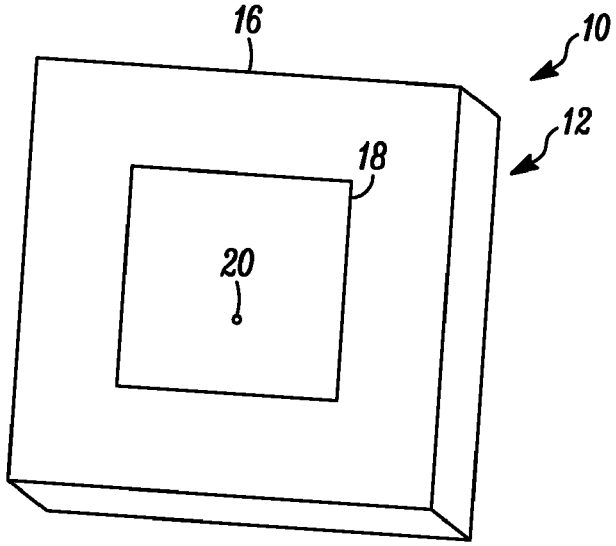
FIG. 1 is a perspective view of a dual-mode antenna design illustrating one side with a patch mode antenna.
Figure 2:
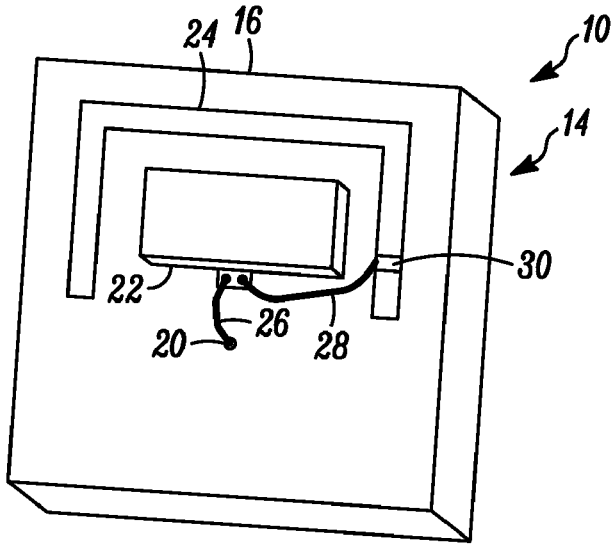
FIG. 2 is a perspective view of the dual-mode antenna design of FIG. 1 illustrating an opposing side of FIG. 1 with a slot mode antenna.

Referring to FIGS. 1-2, in an exemplary embodiment, a dual-mode antenna design 10 of the present invention provides long and short range capability in a single design. FIGS. 1 and 2 illustrate perspective views of opposing sides of the dual-mode antenna design 10 with FIG. 1 illustrating a view of a patch mode antenna 12 and FIG. 2 illustrating a view of a slot mode antenna 14. For descriptive purposes, the patch mode antenna 12 is described as the front side of the dual-mode antenna design 10 and the slot mode antenna 14 is described as the back side of the dual-mode antenna design 10. Those of ordinary skill in the art will recognize the front and back side are relative terms and the basic design of the dual-mode antenna design 10 includes the patch mode antenna 12 and the slot mode antenna 14 on opposing sides. The dual-mode antenna design 10 includes a ground plane 16 forming both of the opposing sides, i.e. the patch mode antenna 12 is formed on one side of the ground plane 16 (e.g. the front side), and the slot mode antenna 14 is formed on the other side of the ground plane 16 (e.g. the back side).

In FIG. 1, the patch mode antenna 12 includes a patch antenna 18 at one half wavelength with the ground plane 16. The patch antenna 18 is a patch with a certain height from the ground plane 16 with a foam or dielectric substrate positioned therebetween the patch antenna 18 and the ground plane 16. The patch antenna 18 may include a patch feed 20 for receiving a cable or transmission line from a radio frequency (RF) module 22. The patch mode antenna 12 has a high gain (e.g. +4 dB(isotropic) or dBi) and is used for long range applications. The patch mode antenna 12 (also known as a Rectangular Microstrip Antenna) and the radiation mechanism arise from discontinuities at each truncated edge of the patch antenna 18. The radiation at the edges causes the patch antenna 18 to be slightly larger than its physical dimension electrically. The ground plane 16 is substantially larger than the patch antenna 18 and the ground plane includes a constant thickness. The patch antenna 18 may be generally constructed on a dielectric substrate, usually employing the same sort of lithographic patterning used to fabricate printed circuit boards. Here, a high dielectric RF substrate may be used between the patch antenna 18 and the ground plane 16 to reduce the patch mode antenna 12 size, such as in a space restricted application. Bandwidth of the patch mode antenna 12 may be improved by increasing antenna height, using a different shape patch with one or more slots, and the like as described further herein. Also, the patch mode antenna 12 may include electromagnetic bandgap structured (EBG) materials. Additionally, the patch mode antenna 12 may be easily designed with circular polarization by using different design techniques as described further herein.

In FIG. 2, the slot mode antenna 14 is created with a U-shaped slot 24 with a size of one and a half wavelength formed on an opposite side of the ground plane 16 as the patch mode antenna 12. In the slot mode antenna 14, the slot 24 radiates electromagnetic waves in similar way to a dipole antenna. The shape and size of the slot 24, as well as the driving frequency, determine the radiation distribution pattern. The position of the slot 24 may be offset from the patch antenna 18 vertically to avoid radiation pattern impact at the designed read direction (i.e. point out from front). The slot mode antenna 14 includes a donut shape pattern and a peak gain of +3 dBi making this mode ideal for short range inventory applications. Additionally, the RF module 22 may be mounted on the ground plane 16, such as, for example, below the slot 24 on the slot mode antenna 14. The RF module 22 includes circuitry and RF components to support transmission and reception of RF signals with each of the patch mode antenna 12 and the slot mode antenna 14. In an exemplary embodiment, the RF signals include RFID transmissions in the UHF band. The RF module 22 connects to each of the patch mode antenna 12 and the slot mode antenna 14 through cables 26, 28, 50 ohm transmission lines, or the like. The RF module 22 is configured to operate one of the patch mode antenna 12 and the slot mode antenna 14 at a time, such as through a user selection via a switch, button, etc. depending on the application. The cable 26 feeds the patch antenna 18 through the patch feed 20, and the cable 28 feeds the slot 24 through a slot feed 30 disposed on the slot 24.

Figure 3:
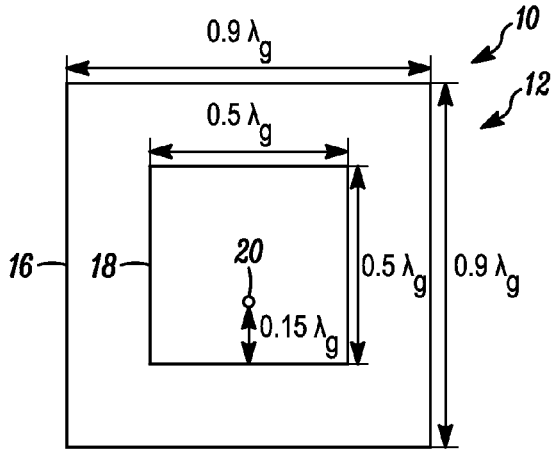
FIG. 3 is a front view of the patch mode antenna.
Figure 4:
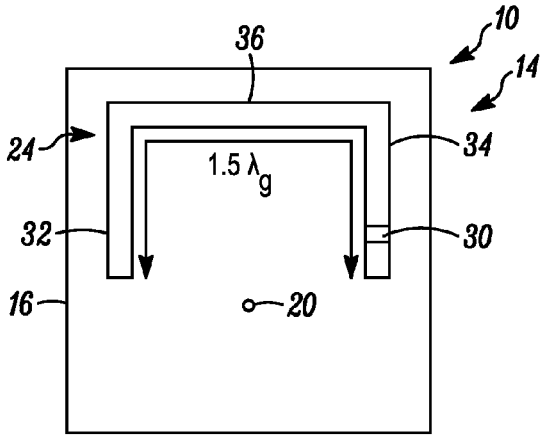
FIG. 4 is a front view of the slot mode antenna.
Figure 5:
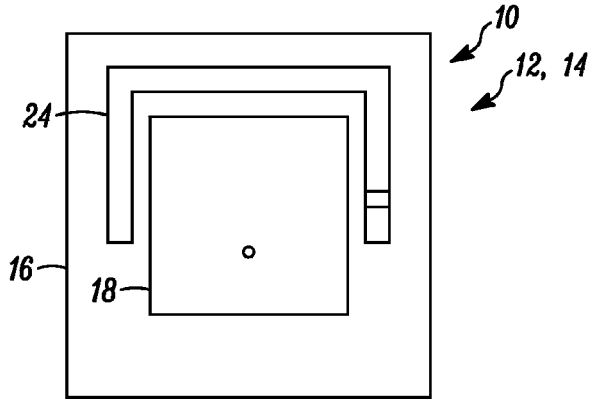
FIG. 5 is a front view of the patch mode antenna and the slot mode antenna superimposed on the same side showing relative positioning of each of the patch mode antenna and the slot mode antenna.

Referring to FIGS. 3-5, in exemplary embodiments, various front views illustrate the dual-mode antenna design 10 of the present invention. FIG. 3 illustrates the patch mode antenna 12, FIG. 4 illustrates the slot mode antenna 14, and FIG. 5 illustrates a view of the patch mode antenna 12 and the slot mode antenna 14 superimposed on the same side of the ground plane 16 showing relative positioning of each of the antennas 12, 14. In FIG. 3, in an exemplary embodiment, the patch mode antenna 12 includes the ground plane 16 at approximately 0.9 times wavelength ($\lambda_g$) where $\lambda_g$ the operating wavelength. The patch antenna 16 is substantially square or planar and each side is approximately 0.5 times wavelength ($\lambda_g$), and the patch feed 20 is located at approximately 0.15 times wavelength ($\lambda_g$) from a bottom edge of the patch antenna 16. Note, these dimensions (e.g. 0.9 times wavelength) were selected for an exemplary embodiment based on product size design limitations. The patch antenna it is not limited to these dimensions, and may include any variation such as a larger ground plan for higher gain, i.e. dimensions may be determined based on application requirements. Also, the feed position of 0.15 time wavelength from bottom edge is tuned, and this may need to be adjusted based on application environment. In FIG. 4, in an exemplary embodiment, the slot mode antenna 14 includes a linear U-shape such that the slot 24 is formed as three linear channels 32, 34, 36. The channels 32, 34 are approximately the same length and each is opposing one another substantially parallel with the channel 36 connecting end points of each of the channels 32, 34. Note, the channels 32, 34, 36 may be integrally formed in the ground plane 16. Collectively, the total length of the three channels 32, 34, 36 and the overall slot 24 is approximately 1.5 times wavelength ($\lambda_g$). Note, the patch antenna 16 size may also be approximately 0.25 times wavelength ($\lambda_g$) with a top edge of the patch antenna 16 grounded, and the slot 24 size may also be designed as approximately 0.5 times wavelength ($\lambda_g$), depending on the application requirements. FIG. 5 illustrates a view of the patch mode antenna 12 and the slot mode antenna 14 superimposed on the same side showing relative positioning of each of the antennas 12, 14. The slot 24 on the ground plane 16 is offset from patch antenna 16 vertically to avoid radiation pattern impact in the designed read direction. Advantageously, these two modes are nicely integrated together in the ground plane 16 without increasing any antenna volume in the dual-mode antenna design 10.

Referring to FIGS. 6-9, in an exemplary embodiment, a patch mode operation and a slot mode operation are illustrated with an exemplary dual-mode antenna design 10*a* of the present invention. In this exemplary dual-mode antenna design 10*a*, the patch mode gain was engineered to be 4 dBi (simulation at 4.7 dBi) and the slot mode gains was engineered to be 2 dBi (simulation at 3.6 dBi). Given this, the read range of the dual-mode antenna design 10 can be calculated using the following equation:

$$R = \left(\frac{\lambda}{4\pi}\right)\sqrt{\frac{P_{reader}G_{reader}G_{tag}}{P_{tag}}}$$

Where $P_{reader}$ is the power of the antenna 12, 14, $G_{reader}$ is the gain of the antenna 12, 14, $G_{tag}$ is the antenna gain of a remote RFID tag being interrogated or read by the reader, $P_{tag}$ is the power needed to turn on the remote RFID tag, and $\lambda$ is the operating wavelength. In an exemplary operation, the RFID tag antenna gain, $G_{tag}$, is 0 dBi, the power needed to turn on the RFID tag, $P_{tag}$, is −10 dBi, the wavelength of a UHF frequency (free space) is 327 mm, and the estimated loss from the RF reader antenna and antenna loss is −3.3 dBi. Thus, for an RF power of 1 W in the RF reader using the dual-mode antenna design 10*a*, the estimated read range for the patch mode antenna 12 is approximately 9 ft., and the estimated read range for the slot mode antenna 14 is approximately 5 ft. (after considering mode impact from the RF module and nearby devices).

Figure 6:
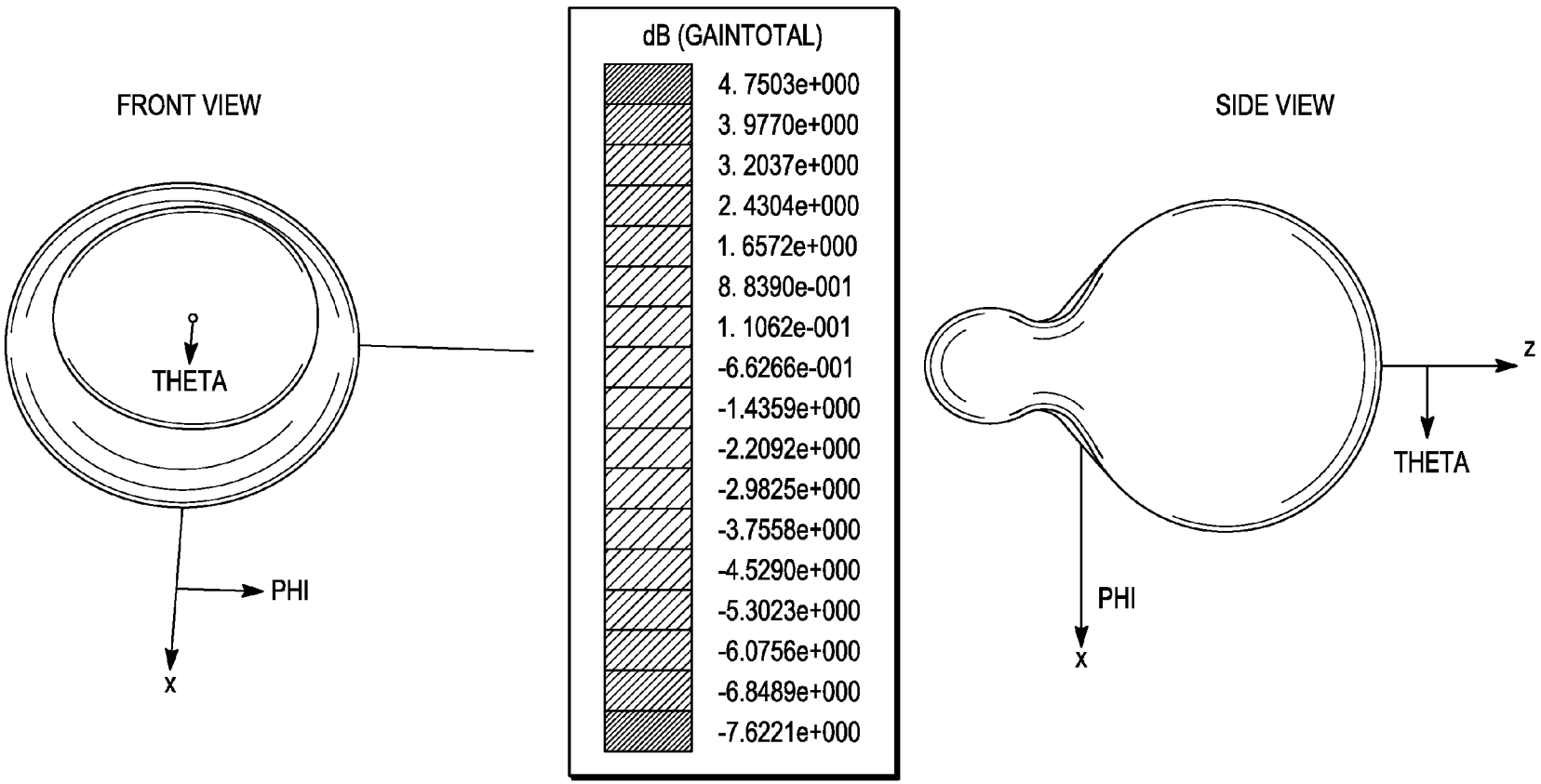
FIG. 6 is a three-dimensional RF antenna gain diagram for an exemplary patch mode antenna.
Figure 7:
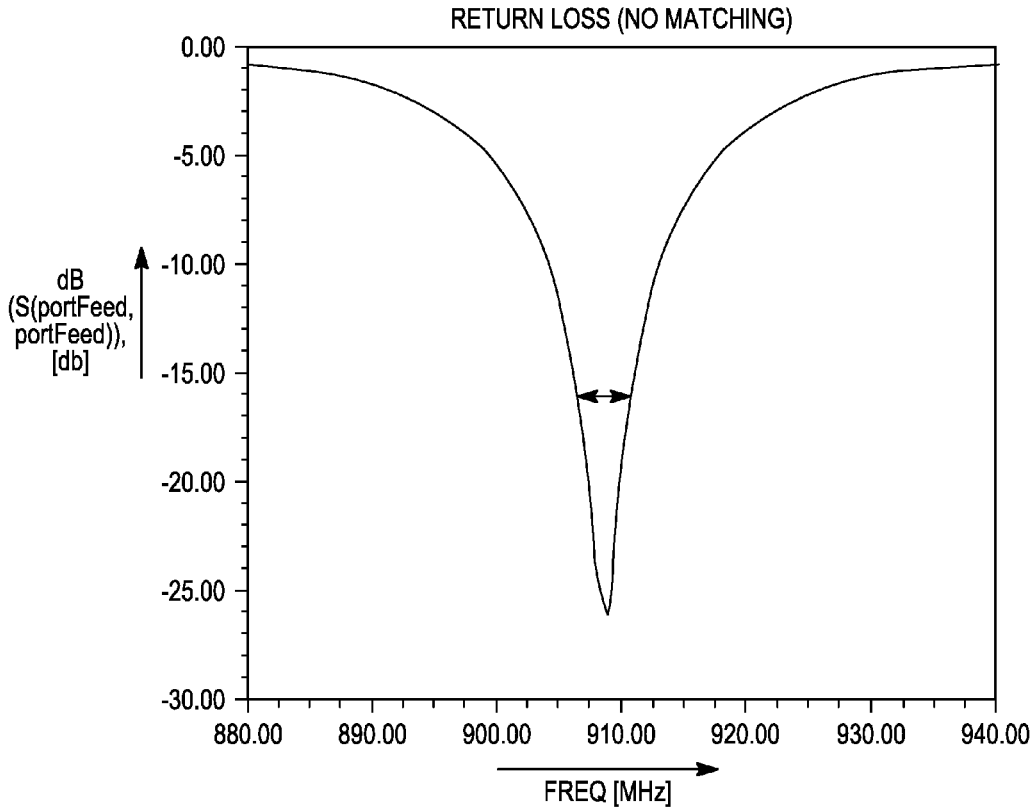
FIG. 7 is a return loss graph versus frequency for the patch mode antenna of FIG. 6.
Figure 8:
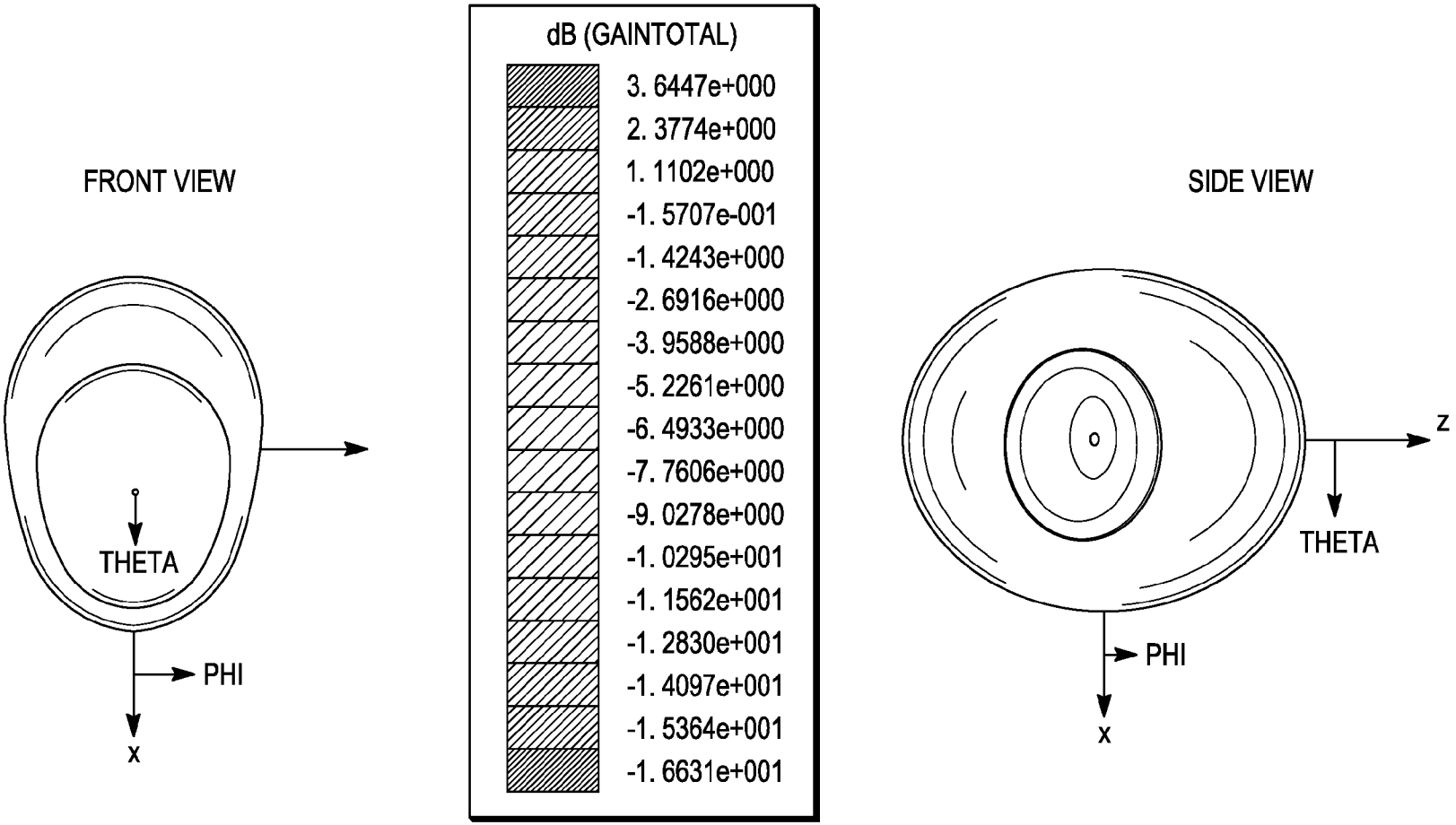
FIG. 8 is a three-dimensional RF antenna gain diagram for an exemplary slot mode antenna.
Figure 9:
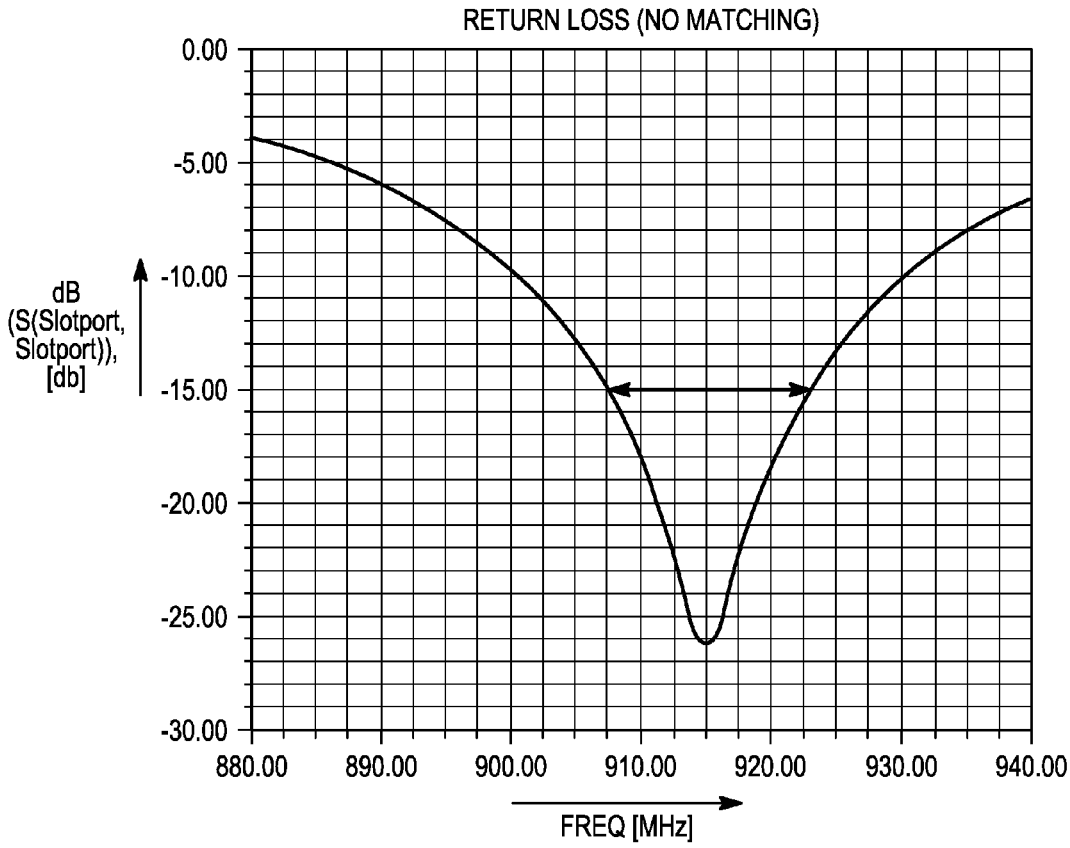
FIG. 9 is a return loss graph versus frequency for the slot mode antenna of FIG. 8.

FIG. 6 illustrates a three-dimensional RF antenna gain diagram for the patch mode antenna 12 in the exemplary dual-mode antenna design 10*a*, and FIG. 7 illustrates a return loss graph versus frequency for the patch mode antenna 12 in the exemplary dual-mode antenna design 10*a*. FIG. 8 illustrates a three-dimensional RF antenna gain diagram for the slot mode antenna 14 in the exemplary dual-mode antenna design 10*a*, and FIG. 9 illustrates a return loss graph versus frequency for the slot mode antenna 14 in the exemplary dual-mode antenna design 10*a*. In this exemplary dual-mode antenna design 10*a*, the antennas 12, 14 are designed on a substrate Rogers TMM® 10 (Thermoset Microwave Materials available from Rogers Corporation) with a dielectric constant of 9.2. The antenna height (of the ground plane 16) is 3.81 mm. The ground plane 16 has height and width of 100 mm, the patch antenna 18 has height and width of 52 mm, and the patch feed 20 is 16 mm from a bottom edge of the patch antenna 18. Here, the peak antenna gain of the patch antenna 18 is 4.7 dBi (although it can be higher by increasing the ground plane 16 size). This antenna bandwidth is narrow, i.e. 5 MHz below −15 dB S11. The slot 24 in the exemplary dual-mode antenna design 10*a* has a width of 4 mm and a total length of 180 mm for a 1.5 guided waveguide. The channels 32, 34 have a length of 54 mm, the channel 36 has a length of 72 mm, and the slot feed 30 is 8 mm above a bottom of the channel 34. The slot 24 is positioned to offset the patch antenna 18 on the opposing side of the ground plane 16 vertically by 10 mm on each side to avoid radiation pattern effect from the patch antenna 18. The slot mode antenna 14 provides a peak gain of 3.6 dBi with a nice donut shape, and the bandwidth below −15 dB S11 is about 20 MHz, using matching and antenna optimization achieves 26 MHz bandwidth.

Figure 10:
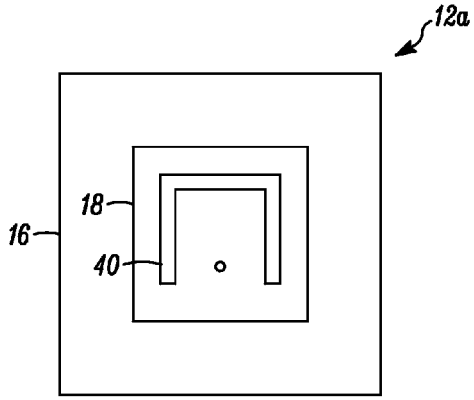
FIGS. 10-13 are front views of various improvements in the patch mode antenna.

Referring to FIGS. 10-13, in various exemplary embodiments, the patch mode antenna 12 bandwidth may be improved through different shaped patterns in the patch antenna 18. FIG. 10 illustrates a patch mode antenna 12*a* with a U-shaped slot 40 in the patch antenna 18. Here, the slot 40 is shaped similarly to the slot 24 on the slot mode antenna 14. The slot 40 adds additional bandwidth to the patch mode antenna 12*a* by providing two closed and distinct resonance frequencies in the antenna 12*a* to give broadband operation.

Figure 11:
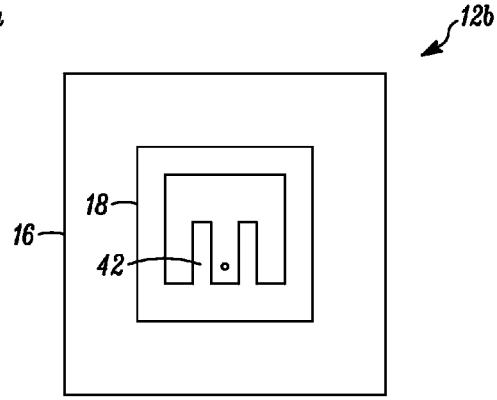
Figure 12:
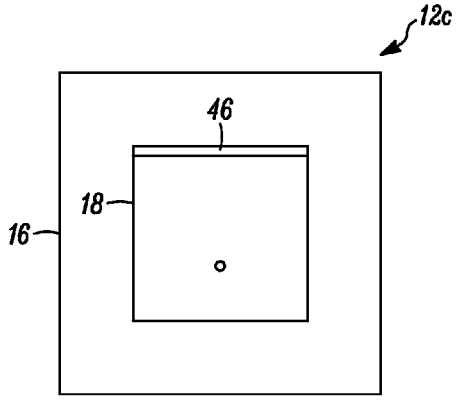
Figure 13:
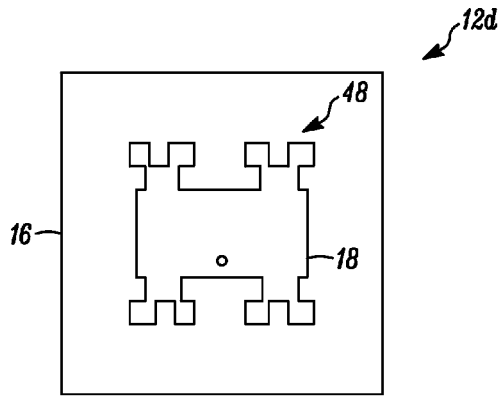

FIG. 11 illustrates a patch mode antenna 12*b* with E-shaped slots 42 formed in the patch antenna 18. The patch mode antenna 12*b* has additional bandwidth as compared to the patch mode antenna 12 without the slots 42. Further, the bandwidth may be optimized with respect to notch length, width, and position of the slots 42. FIG. 12 illustrates a patch mode antenna 12*c* with a top edge 44 of the patch antenna 18 connected to ground, i.e. the ground plane 16. As described herein, connecting the patch antenna 18 to ground enables a smaller antenna. For example, here, the patch antenna 18 may be 0.25 times wavelength ($\lambda_g$) in height and width. Finally, FIG. 13 illustrates a patch mode antenna 12*d* with a fractal design 48 in the patch antenna 18. The fractal design 48 enables the patch mode antenna 12*d* to exhibit characteristics that are associated with the geometric properties of fractals in the fractal design 48. Those of ordinary skill in the art will recognize the exemplary patch mode antennas 12*a*-12*d* are shown here for illustration purposes, and the present invention contemplates use of any modification to the patch mode antenna 12 to improve bandwidth, gain, etc.

Figure 14:
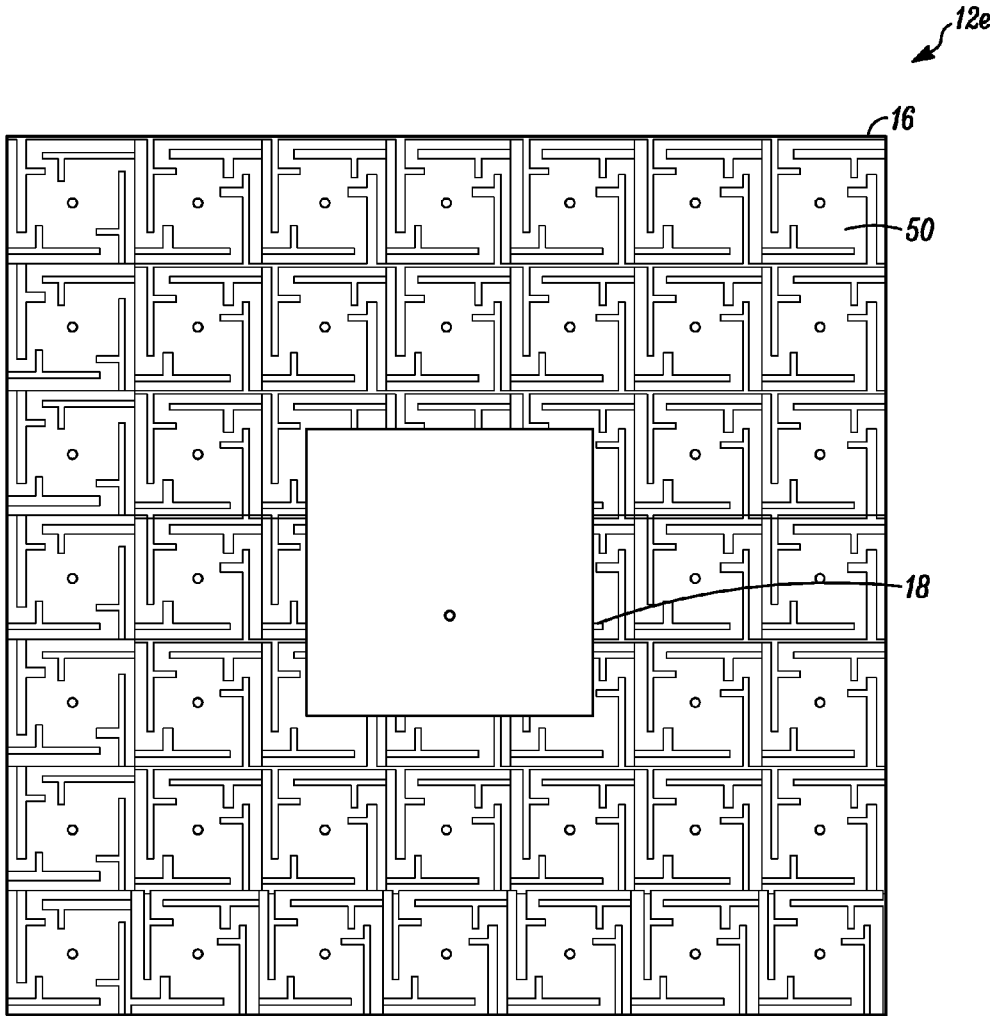
FIG. 14 is a front view of an exemplary patch mode antenna integrated with an Electromagnetic bandgap structured (EBG) material.

Referring to FIG. 14, in an exemplary embodiment, a patch mode antenna 12*e* may be integrated with an EBG structure 50 between the patch antenna 18 and the ground plane 16. The EBG structure 50 is formed from periodic, composite dielectrics with periodic spacings that are an appreciable amount of the wavelength ($\lambda_g$) that give rise to EBGs. The EBG structure 50 is a material in which periodic inclusions inhibit wave propagation due to destructive interference from scattering from the periodic repetition. The EBG structure 50 may be used to prevent the propagation of an allocated bandwidth of frequencies, for certain arrival angles and polarizations. For example, the EBG structure 50 may be used to ensure regulatory compliance in terms of frequencies used by the patch mode antenna 12*e*.

Figure 15:
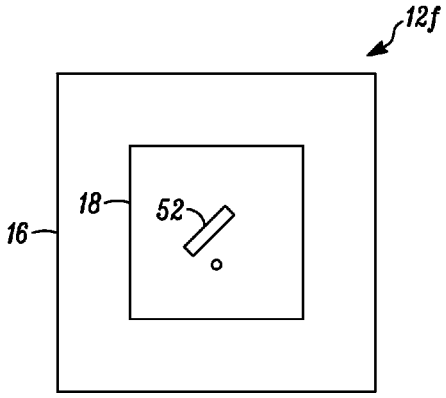
FIGS. 15-18 are front views of various patch mode antennas providing circular polarization.
Figure 16:
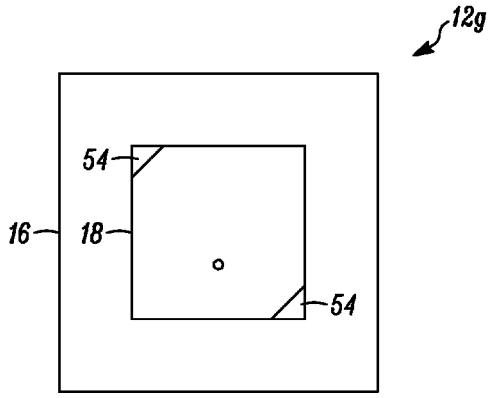
Figure 17:
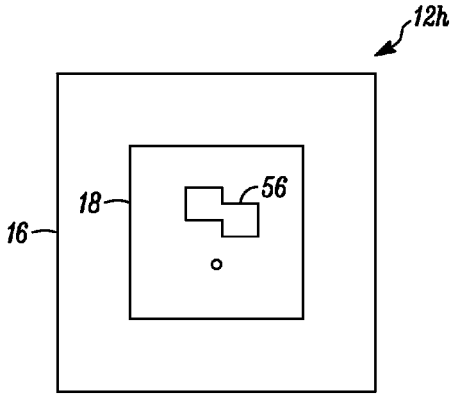
Figure 18:
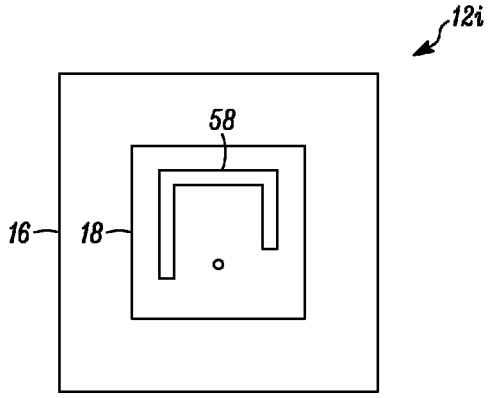

Referring to FIGS. 15-18, in various exemplary embodiments, patch mode antennas 12*f*-12*i* may include various slots in the patch antenna 18 to enable circular polarization. FIG. 15 illustrates a patch mode antenna 12*f* with a rectangular slot 52 cut along a diagonal in the patch antenna 18. FIG. 16 illustrates a patch mode antenna 12*g* with corners 54 cut along diagonals in opposing corners of the patch antenna 18. FIG. 17 illustrates a patch mode antenna 12*h* with two conjoined adjacent rectangular slots 56 along a diagonal in the patch antenna 18. FIG. 18 illustrates a patch mode antenna 12*i* with a U-shaped slot 58 on the patch antenna 18 with one side of the slot 58 slightly longer than its opposing side. Each of these patch antennas 12*f*-12*i* utilize slots or other feature on the patch antenna 18, causing the current distribution to be displaced. A square patch, such as the slots 56, which has been perturbed slightly to produce the patch antenna 18 to be driven along a diagonal and produce circular polarization.

Figure 19:
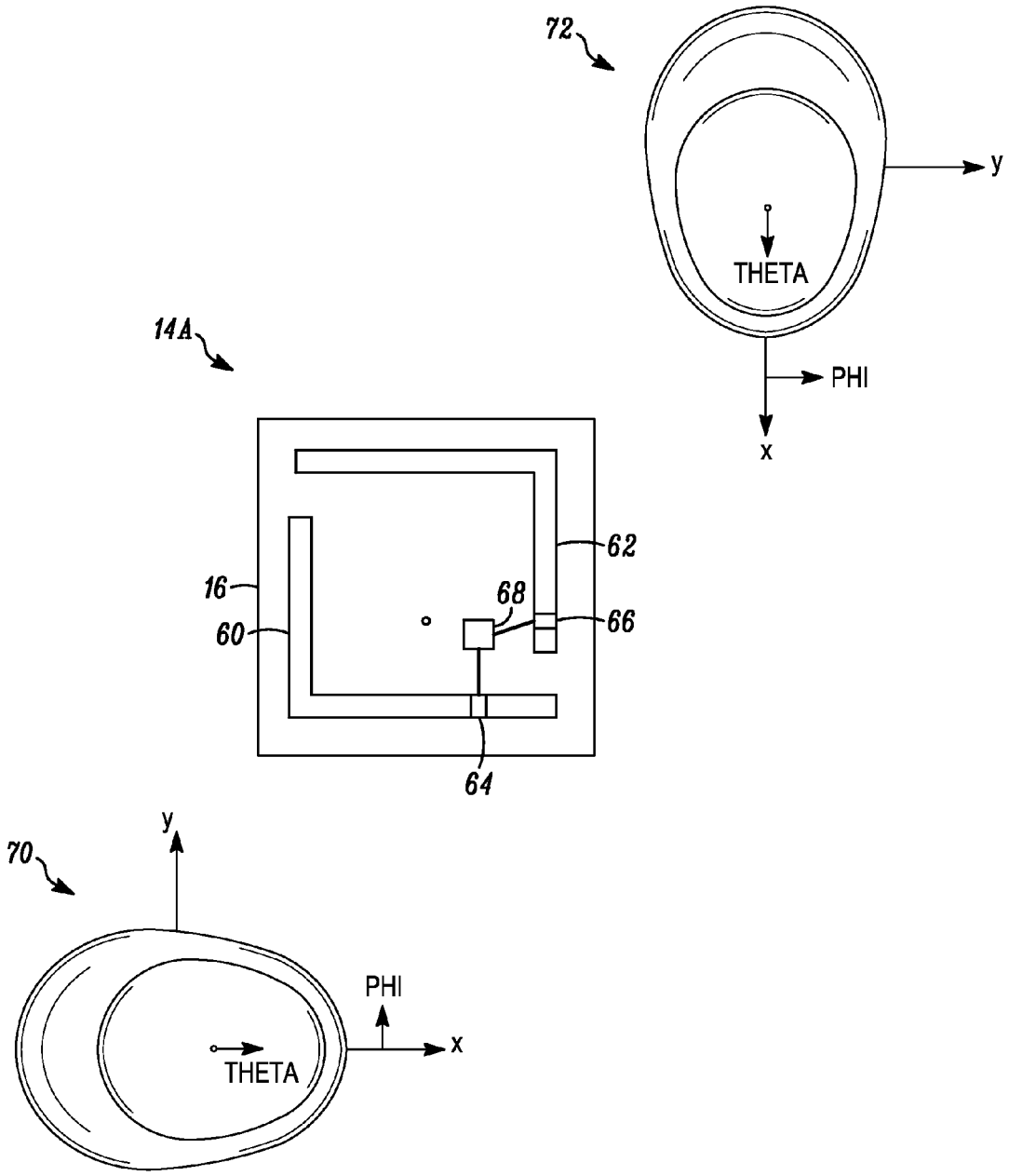
FIG. 19 is a front view of an exemplary slot mode antenna modified to provide dual-polarization.

Referring to FIG. 19, in an exemplary embodiment, a slot mode antenna 14*a* may be modified to provide dual-polarization as required. Specifically, the U-shape slot 24 may be changed to two orthogonal slots 60, 62. Each of the orthogonal slots 60, 62 includes an L-shape. The slots 60, 62 include slot fees 64, 66 that are fed by a power divider 68. The slot 60 provides horizontal excitation for horizontal polarization 70 and the slot 62 provides vertical excitation for vertical polarization 72. The power divider 68 splits power from the RF module 22, and may also be a 90 degree hybrid.

Figure 20:
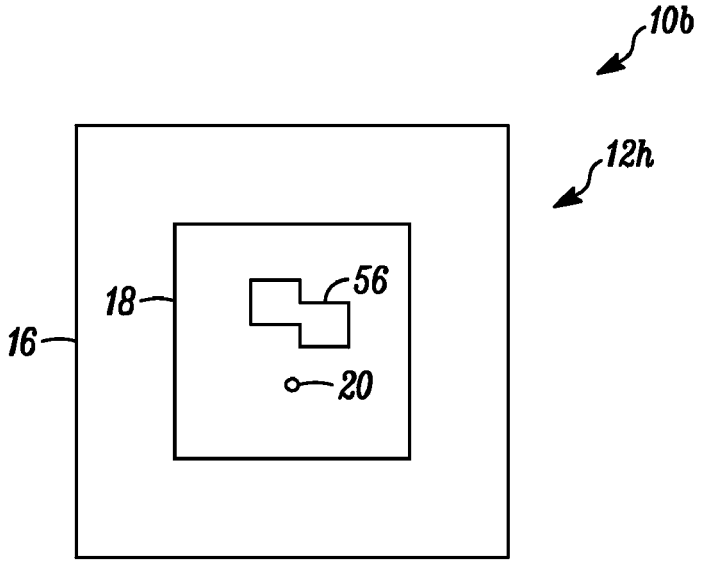
FIGS. 20 and 21 are front views of an exemplary dual-mode antenna design with circular polarization on the patch mode antenna (FIG. 20) and dual-polarization on the slot mode antenna (FIG. 21)
Figure 21:
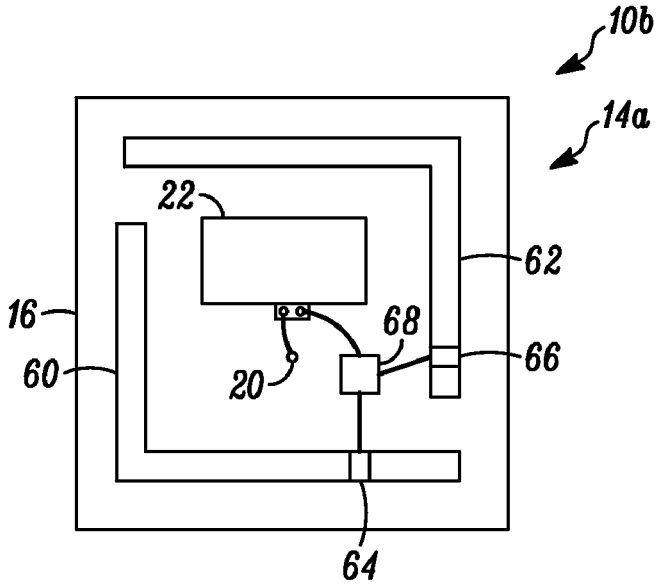

Referring to FIGS. 20 and 21, in an exemplary embodiment, a dual-mode antenna design 10*b* is illustrated with circular polarization on the patch mode antenna 12*h* and dual-polarization on the slot mode antenna 14*a*. As described herein, each of the antennas 12*h*, 14*a* is on the ground plane 16 on opposing sides. The antenna design 10*b* includes the RF module 22 disposed on the ground plane 16 between the slots 60, 62. The RF module 22 feeds the patch antenna 18 through the patch feed 20 via a cable and/or transmission line and feeds the power divider 68 via a cable and/or transmission line. In the dual-mode antenna design 10*b*, the circularly polarization patch mode antenna 12*h* may be used for long range applications and the dual-polarization slot mode antenna 14*a* may be used for short range applications. The RF module 22 may include circuitry to switch between each of the antennas 12*h*, 14*a*, i.e. to determine which operating mode and which cable/transmission line is active.

Figure 22:
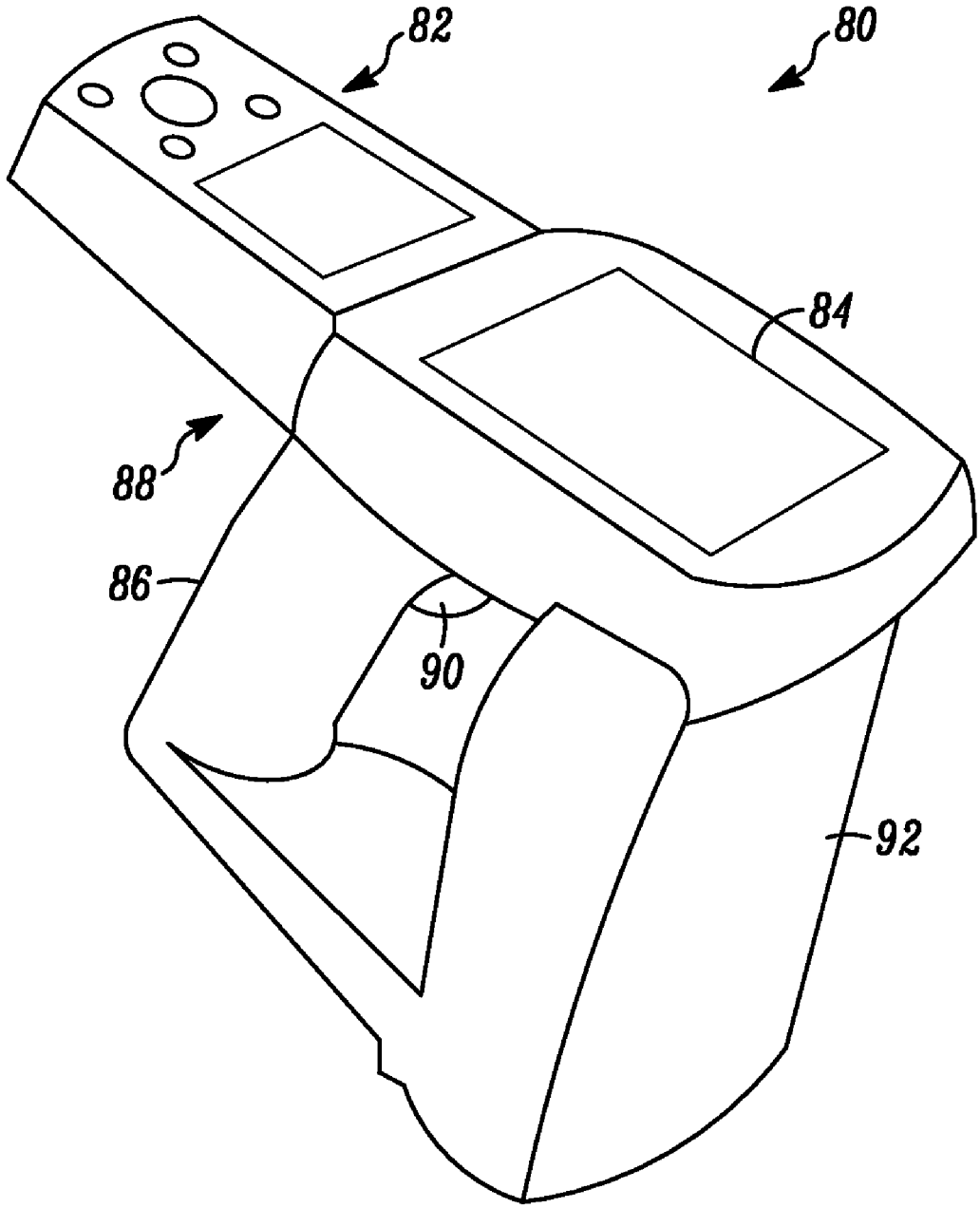
FIG. 22 is a perspective view of a portable RFID reader capable of operating in both short and long range operational modes with a single dual-mode antenna.

Referring to FIG. 22, in an exemplary embodiment, a portable RFID reader 80 is illustrated capable of operating in both short and long range operational modes with a single antenna. The RFID reader 80 may include various input devices 82, a display screen 84, and a handle 86 on a housing 88. The housing 88 may be a single unit that contains all of the components of the RFID reader 80. Alternatively, the housing may be various interconnected units containing all of the components of the RFID reader 80. The input devices 82 may include keys, a keypad, a mouse/pointing device, scroll bars, touch pads, and the like. The display screen 84 may include a liquid crystal display (LCD) or the like for presenting a graphical user interface and associated data to a user. The user generally operates the RFID reader 80 through a combination of inputs and outputs with the input devices 82 and the display screen. In the present invention, the RFID reader 80 is configured to interrogate remote RFID tags wirelessly through the use of the various antenna designs described herein. Specifically, the RFID reader 80 may include a single antenna, i.e. the dual-antenna design 10, capable of operating in two modes—a long range and a short range mode. In particular, the RFID reader 80 may include one or more triggers 90 for selecting the operational mode of the antenna. In an exemplary embodiment, the antenna may be disposed within the housing 88 at an antenna housing 92. For example, the antenna includes any the dual-antenna designs 10 described herein. The user may hold the RFID reader 80 via the handle 86 thereby orienting the antenna housing 92 in an outward direction from the user. Here, the antenna disposed within is oriented vertically.

The RFID reader 90 provides a compact, integrated dual-mode antenna capable of a patch mode and a slot mode. The patch mode is designed by a patch antenna at one half times operating wavelength of the RFID reader 90 with a ground plane. In a space restricted application case of the RFID reader, a high dielectric RF substrate may be used between patch and ground to reduce antenna size. This mode antenna has high gain (+4 dBi) used for long range application. Antenna bandwidth can be improved by increasing antenna height, different shape patch with slot, EBG structure, etc. to meet regulatory requirements. Also, the patch antenna may be easily designed with circular polarization by using different design techniques described herein. The slot mode is created by U-shaped slot with sized at 1.5 times wavelength on the ground plane at bottom. The slot position is offset from the patch vertically (relative to the antenna housing 92) to avoid radiation pattern impact at the designed read direction (i.e. point out from front of the antenna housing). With a donut shape pattern and peak gain of +3 dBi, the slot mode is ideal for short range inventory applications. If dual-polarization is required, two orthogonal slots on the ground (one for vertical polarization and the other one for horizontal) may be designed and fed by a power divider or a 90 degree hybrid.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A radio frequency identification reader, comprising:

a housing;

one or more input devices;

an output display;

a dual-mode antenna disposed in the housing, wherein the dual-mode antenna comprises a ground plane with a first side comprising a patch mode antenna and a second side comprising a slot mode antenna;

a radio frequency module disposed on the ground plane on the second side;

a connection from the radio frequency module to the patch mode antenna on the first side through a patch feed in the ground plane;

a connection from the radio frequency module to the slot mode antenna through a slot feed on the slot mode antenna; and a switching mechanism for operating the dual-mode antenna with either the patch mode antenna for a first operational mode or the slot mode antenna for a second operation mode.

2. The radio frequency identification reader of claim 1, wherein the patch mode antenna comprises a patch disposed on the ground plane between one of foam or a dielectric substrate and a patch feed through the patch on the first side to the second side;

wherein the patch and the ground plane are dimensioned based on an operating wavelength of the antenna; and wherein the slot mode antenna comprises a slot in the ground plane dimensioned based on the operating wavelength of the antenna and a slot feed disposed on the slot.

3. The radio frequency identification reader of claim 2, wherein a position of the slot on the second side of the ground plane is offset vertically from a position of the patch on the first side of the ground plane thereby avoiding radiation pattern impact in a designed read direction.

4. The radio frequency identification reader of claim 1, wherein the patch mode antenna is configured to operate with circular polarization and the slot mode antenna is configured to operate with dual-polarization.

* * * * *